US006737579B1

(12) United States Patent
Laufer et al.

(10) Patent No.: US 6,737,579 B1
(45) Date of Patent: May 18, 2004

(54) ARRANGEMENT FOR THE SEALED LEAD-THROUGH OF A CONDUCTOR THROUGH THE WALL OF A HOUSING

(75) Inventors: Helmut Laufer, Gerlingen (DE); Wolfgang Fehlmann, Stuttgart (DE); Johannes Pflug, Weil-der-Stadt (DE); Hans-Peter Bauer, Ditzingen (DE); Wolfgang Braun, Ditzingen (DE); Ewald Eblen, Stuttgart (DE); Peter Nordhaus, Ditzingen (DE); Peter Zweigle, Ditzingen (DE); Elmar Huber, Pliezhausen (DE); Roland Gronenberg, Stuttgart (DE); Jörg Wolke, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 1732 days.

(21) Appl. No.: 08/861,918

(22) Filed: May 22, 1997

Related U.S. Application Data

(63) Continuation of application No. 08/527,077, filed on Sep. 12, 1995, now abandoned, which is a continuation of application No. 08/232,736, filed on Apr. 25, 1994, now abandoned, which is a continuation of application No. 07/910,306, filed as application No. PCT/DE91/00879 on Nov. 13, 1991, now abandoned.

(30) Foreign Application Priority Data

Dec. 1, 1990 (DE) ..... 40 38 394

(51) Int. Cl.[7] ..... H01J 15/00

(52) U.S. Cl. ..... 174/50.52; 174/65 R; 439/271; 277/919

(58) Field of Search ..... 174/65 R, 50.5, 174/50.51, 50.52, 50.56, 110 N, 117 F, 117 FF; 439/76.1, 271; 277/901, 919

(56) References Cited

U.S. PATENT DOCUMENTS 3,996,914 A * 12/1976 Crall et al. ..... 277/919
4,800,732 A * 1/1989 Newton ..... 277/919
5,524,908 A * 6/1996 Reis ..... 277/919

* cited by examiner

*Primary Examiner*—David P. Bryant
(74) *Attorney, Agent, or Firm*—Michael J. Striker

(57) ABSTRACT

An arrangement for sealed leading of at least one conductor has a housing having a housing wall which surrounds a housing aperture, a closing part which closes the housing aperture, a seal arranged between the closing part and the housing wall which surrounds the housing aperture, at least one conductor track serving as at least one conductor which is pressure-tightly connected with a conductor track carrier formed by an elastic flexible carrier film, the conductor track carrier being routed between the housing and the closing part, the at least one conductor being insulated from outside and being in close contact with the seal in a closing position of the closing part, the closing part being held to the seal by a closing force, a part of the conductor track carrier having an elastic flexible extension which protrudes within the housing, an electrical component which is movably arranged within the housing, the extension being bent for contacting the at least one conductor track thereon on at an end of the extension directly to the electric component thereby fixing the end of the extension to the electric component which is movably arranged within the housing, so that the end of the extension follows each movement of the electric component.

14 Claims, 5 Drawing Sheets

ARRANGEMENT FOR THE SEALED LEAD-THROUGH OF A CONDUCTOR THROUGH THE WALL OF A HOUSING

This application is a continuation of application Ser. No. 08/527,077 filed Sep. 12, 1995, now abandoned, which in turn is a continuation of application Ser. No. 08/232,736 filed on Apr. 25, 1994, now abandoned, which in turn is a continuation of application Ser. No. 07/910,306 filed on Jul. 15, 1992, now abandoned, which is a 371 of PCT/DE91/00879, filed Nov. 13, 1991.

BACKGROUND OF THE INVENTION

The present invention relates to an arrangement for the sealed lead-through of at least one conductor through the wall of a housing.

More particularly, it relates to an arrangement in which at least one conductor is led through a housing which encloses a first medium, into a region which has a second medium, and a housing aperture closed by a closing part with a seal arranged between the closing part and the housing wall which surrounds the housing aperture.

Such an arrangement is known from DE-OS 28 45 139, in which a fuel filled interior of a fuel injection pump is provided with electrical control units, angle, and route transmitters, the connections of which lead from the fuel filled interior to a control device. The connections of the electrical components are taken to a breakthrough in the wall of the fuel injection pump housing, with the breakthrough being closed by a closing plate which is pressed tightly onto a ring seal supported in the housing. The connections of the structural components are routed outwards through holes in this seal plate to the pins of a plug-type connector. Sealing of the breakthrough and fixing is by means of soldering or embedding in a casting compound in the holes of the intermediate plate. This arrangement is rather elaborate and difficult to handle during assembly. While in the state of technology, the electrical components are accommodated in a fixed location, a further difficulty results if a component is accommodated as a movable item. It is then no longer possible to use rigid conductor connections from the connection point on the closure plate. A further disadvantage is that all contact points both between the electrical component and the conductor which leads away, and the conductor of the connection to the external plug pins, are exposed to the fuel.

SUMMARY OF THE INVENTION

Accordingly, it is an object of the present invention to provide an arrangement of the above-mentioned general type, which avoids the disadvantages of the prior art.

In keeping with these objects and with others which will become apparent hereinafter, one feature of the present invention resides, briefly stated, in an arrangement in which the conductor is routed through a space between the closing part and the housing wall and is in close contact with the seal, at the very latest, in the closing position of the closing part.

When the arrangement is designed in accordance with the present invention it has the advantage that only a portion of the conductor connections is arranged within the fuel filled space and that the conductors) is/are routed to the outside through the separating point between the housing aperture and the closure part. This makes a separate fluid-tight connection between the internally arranged conductor and one outside the housing which leads away, to a plug, or to the connection of an electrical device, a control unit, or a circuit part, obsolete. With the use of the seal on the closure part, the lead-through point of the conductor(s) is tightly enclosed, sealing the housing at the same time.

In accordance with another feature of the present invention, two seals are arranged between the housing wall and the closing part and the conductor is routed through between the seals. This construction provides an improvement of the seal. In accordance with another feature of the present invention, the seal is a shaped seal which can be placed in recesses of the adjacent sides of the housing wall or a closing part. Here the sealing element or the sealing compound can be applied to the conductor with particular advantage. In accordance with a further feature of the present invention, the conductor is configurated as one entity from a conductor track which is pressure-tightly connected with a conductor track carrier and insulated against the outside. In a particularly advantageous manner, this contributes to the solution of the problem of a simple tight lead-through of conductors through the wall of a housing. The conductor carrier is advantageously clamped between the closure part and the housing, and does not form a bulky arrangement at the lead-through point by virtue of the fact that the conductor is designed in the form of flat copper tracks, so that high safety sealing against significant pressure differences between a medium inside the housing and a medium outside the housing, is ensured. The medium may be of different types, for example, liquid on one side and gaseous on the other side, or they may be of the same type, with one medium being in a physical state which differs from that of the other medium. With a sturdy design of the conductor track support or under light pressures, the conductor track carrier itself may form the closure part. However, in this advantageous arrangement, the conductor track support is an elastic carrier film, preferably polyamide, which supports the conductor tracks, and these in turn may be covered by an elastic cover film. The carrier film advantageously forms, a movable connection to the movable electrical components inside the housing.

The carrier film can be advantageously arranged on a carrier plate which supports the carrier film, or the carrier film may be provided on its own, if it is not exposed to large mechanical forces. To improve the tight lead-through, the carrier film may be routed through a seal, or, sealing materials may be applied to the carrier film. In this case, the carrier film can be used on its own, without any carrier plate. Together with the applied sealing compound, it forms a uniformly handling item which is easy to mount. A further feature of the present invention is that in the adherence region of the closing part to the housing wall, the carrier film has an all-round ring connected in particular on both sides with a seal, with an extension of the ring on each side carrying the conductor track leading from this ring to the interior of the housing and to the outside. This design results in a ring, having, for example, sealing material on both sides, which is then placed between the closing part and the housing wall and the otherwise provided shaped seal between the closing part and the housing wall. A carrier film strip or tail extends to the pump interior to provide a flexible contact with a movable electrical component, and to the outside the carrier film extends with a prolongation to make contact with other electrical components, such as an electrical control unit. Together with the coated carrier film, a component of the same thickness is inserted in the vicinity of the seal between the closure part and the housing, ensuring optimum seals.

The embodiments in accordance with the invention are of particular advantage when used in fuel injection pumps.

However, there are many other applications wherever it is important to provide a simple and easily assembled lead-out of conductors from housings which need to be kept tightly sealed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
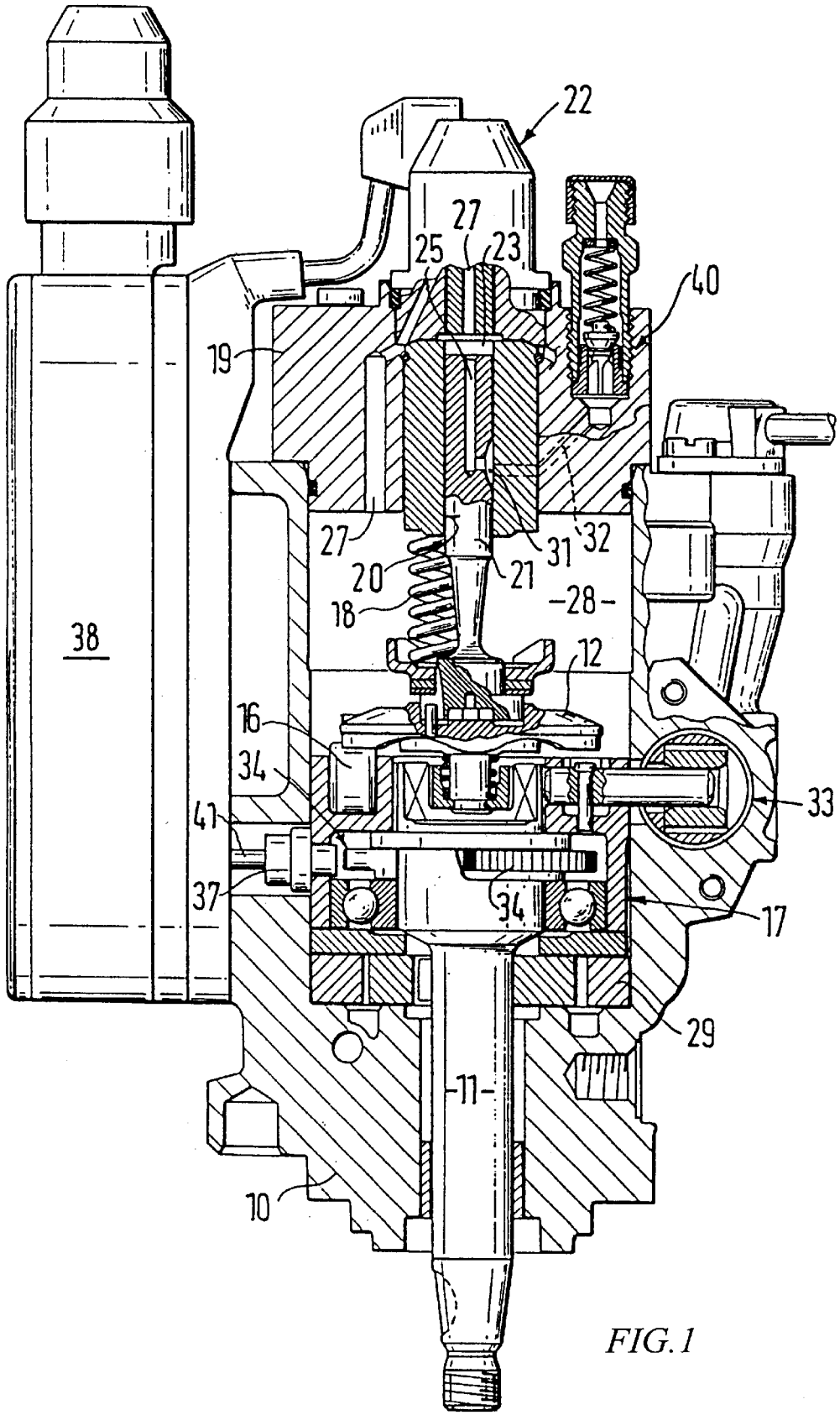
FIG. 1 shows a section through a distributor fuel injection pump, in which the arrangement in accordance with this invention can be applied.

FIG. 1 shows a fuel injection pump of the distributive type for Diesel engines. A drive shaft 11 is supported in housing 10 and is coupled with an eccentric disc 12, which is arranged transversely to the axis of the drive shaft. This is held on rolls 16 by a spring 18, from which it rolls off during the rotation of the drive shaft, imparting a reciprocating motion in addition to the rotary motion. The rolls 16 are held in a roll ring 17 which is supported in the housing and which can be additionally adjusted in the housing by an injection timing mechanism 33, but which is essentially held in a fixed position. The eccentric disc 12 has a pump plunger 21 which is linked to the direction of rotation of the eccentric disc and imparts a corresponding rotary and reciprocating motion. The pump plunger slides with a tight fit in a cylindrical bore 20 and closes a pump working chamber 23 at the front. This is connected to the pump chamber interior, namely the suction chamber, via a fuel channel 27, for so long as a solenoid valve 22, not shown here, which is controlled by a control unit 38, holds the channel 27 open. The channel opens during the suction stroke of the pump plunger so as to fill the pump working chamber, and for portions of the pump plunger delivery stroke, in order to determine the fuel injection volume and the timing of the injection. The fuel displaced from the pump working chamber 23 by the pump plunger 21 passes via a longitudinal channel 25 in the pump plunger and a distribution groove 31 connected with it, to an injection line 32, which is connected via a pressure valve 40 to a fuel injection valve, not shown here in any detail. According to the number of injection valves to be supplied at each pump plunger revolution, the injection lines 32 are arranged around the circumference of the cylindrical bore 20, so that with each pump plunger delivery stroke, a different fuel injection line is supplied with pressurized fuel. The pump interior is filled with fuel by a fuel delivery pump 29 and is maintained at a pressure which is preferably dependent on the number of revolutions. The roll ring 17 is adjusted corresponding to this speed dependent pressure and used to alter the angle of rotation with which the stroke of the cam disc commences.

To control the solenoid valve 22, the control unit 38 requires information on the relative position of the roll ring, or as to the start of the delivery stroke of the pump plunger. For this purpose, a segmented disc 34 is placed on the drive shaft 11 which turns synchronously with the drive shaft. On the roll ring 17, facing the front face of the segment disc, an angle sensor 37 is arranged which generates control signals, corresponding to the passing segments and transmits the signals via a connection line 41 to the control unit 38. As shown in the drawing, this sensor is arranged in the fuel filled space.

Figure 2:
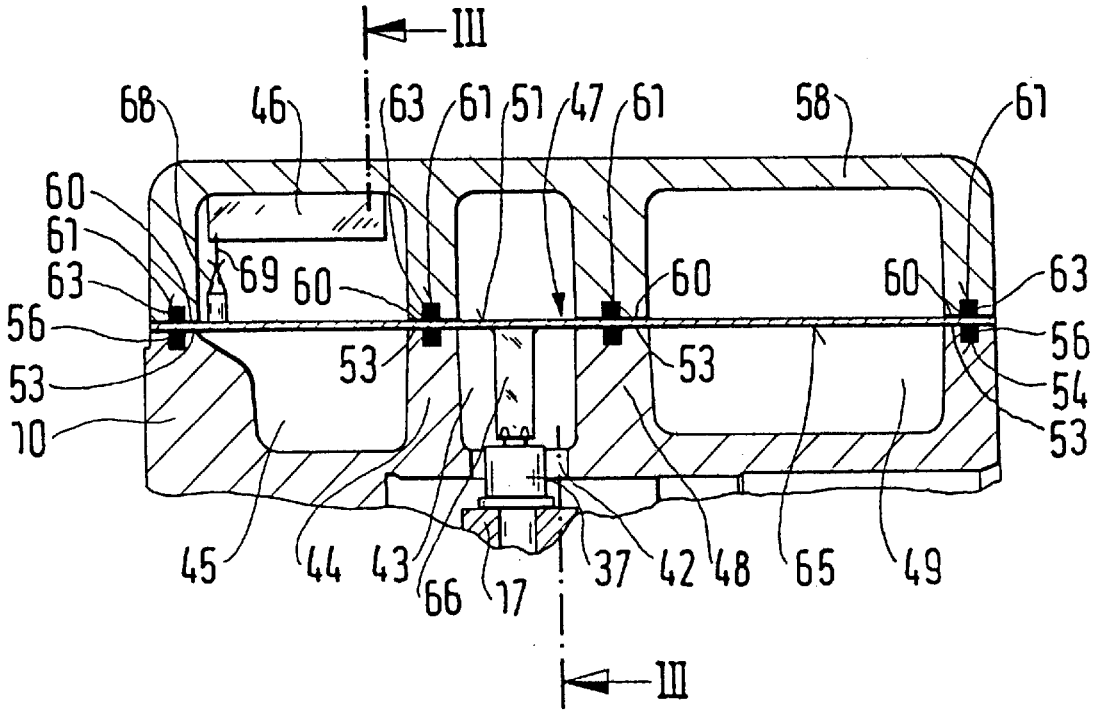
FIG. 2 shows a partial section through the fuel injection pump in accordance with FIG. 1, with a first embodiment example of the invention.

FIG. 2 now shows a section through the adjacent housing part, not sectioned, of the fuel injection pump in accordance with FIG. 1. The angle sensor 37 will again be recognized, which locates in the roll ring 17 and projects radially outward through an opening 42 into an adjacent space 43. A side wall 44 separates this space from an adjacent space 45 which is at atmospheric pressure and which accommodates the circuit part 46 of the control unit 38. An adjacent space 49, which is separated by another side wall 48 of the space 43 may be filled with fuel, where it is possible that this fuel is at a different pressure from that in space 43.

Figure 3:
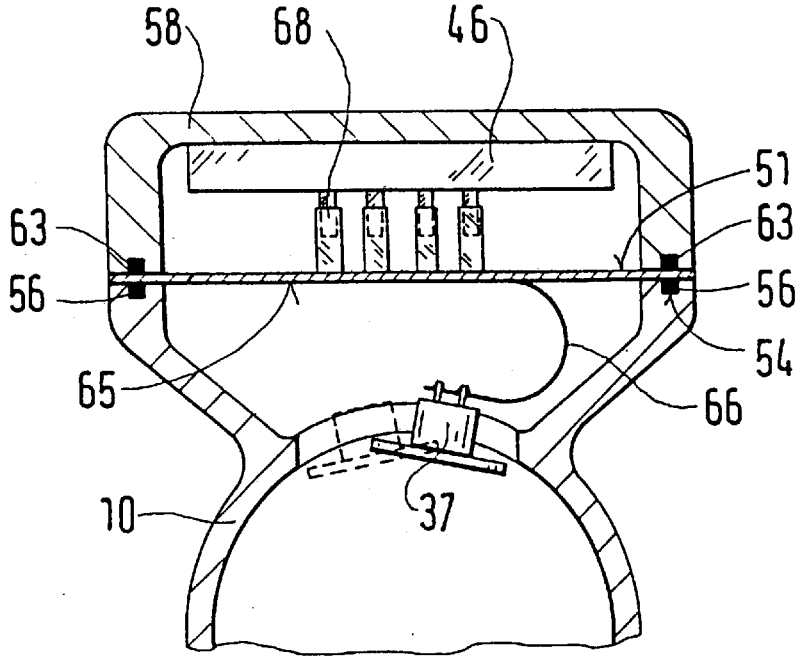
FIG. 3 shows a section through the section of FIG. 2 in accordance with line III—III.

FIG. 3 shows a section through FIG. 2 along the line III—III. Both figures further show an intermediate plate 51 which comes to rest on the front faces 53 of the side walls 44 and 48 which form an opening 47 of the space 43, and on front faces of the other limiting walls of the spaces 45 and 49. These front faces 53 have grooves 54 which are interconnected and into which a shaped seal 56 is inserted, to effect a seal between the intermediate plate 51 and the front faces 53. The other side of the intermediate plate 51 has a housing cover 58 resting against it. The cover serves as the closing part of the injection pump housing and has corresponding front faces 60 which are opposite the front faces 53 of the side walls and housing walls. These front faces are also provided with grooves 61, in which there is a shaped seal 63, sealing the intermediate plate 51 from the other side.

The intermediate plate may have through-passages between those parts of spaces 45, 43 and 49 which are on the pump side and on the closure part side. These connection cross-sections are not shown here. At the side of the injection pump housing 10, a conductor film 65 is laminated onto the intermediate plate. This film is a carrier film 64 of polyamide, on which copper conductor tracks are arranged. The tracks are preferably enclosed by a cover film which again may be of polyamide, and are thus electrically insulated against contact with the housing part. The conductor film or carrier film is known by the trade name of "Kapton" film. This conductive film or carrier film of conductor tracks extends over the whole of the intermediate plate which closes the spaces 43, 45 and 49. In space 43, a conductor film tail 66 leads off. It may be formed by free-cutting from the remaining film material, and has not been laminated onto the intermediate plate. As shown in the section in FIG. 3, the film tail is bent over and is contacted by and fixed to the conductor tracks on the angle sensor 37. The conductor film 65 is very flexible, and due to these properties, the angle sensor can move from the continuous-line position to the position shown by a dashed line, without hinderance and without impairment of the electrical connection.

The connection between the angle sensor 37 and the conductors is made in the fuel filled space, and the onward routing of the conductors from this fuel filled space into the air filled space 45 is made on the carrier film which is passed with a close fit through the housing gap between the front faces 60 and 53. In the air filled space 45, the conductor tracks of the carrier film are contacted by means of flag receptacles 68 or are soldered, and these are in turn coupled to the connections 69 for the circuit part 46 arranged in this air filled space. Due to the conductors between the angle sensor, for example, and the control unit being designed in the form of conductor tracks, these have a very small lead-through cross-section in terms of height. This permits a very simple and tight lead-through of the connections through the housing wall 44 outwards into the air filled space 45. The shaped seals 56,63 attach flush to the conductor film 65, tightly sealing the space 43. The conductor film is supported by the intermediate plate 51, which in turn forms support points in the outer region for the flag receptacles 68. This provides an arrangement which is very simple to mount, with good flexibility of the connection between the movable angle sensor part and the tight conductor lead-through to the outside.

Figure 4:
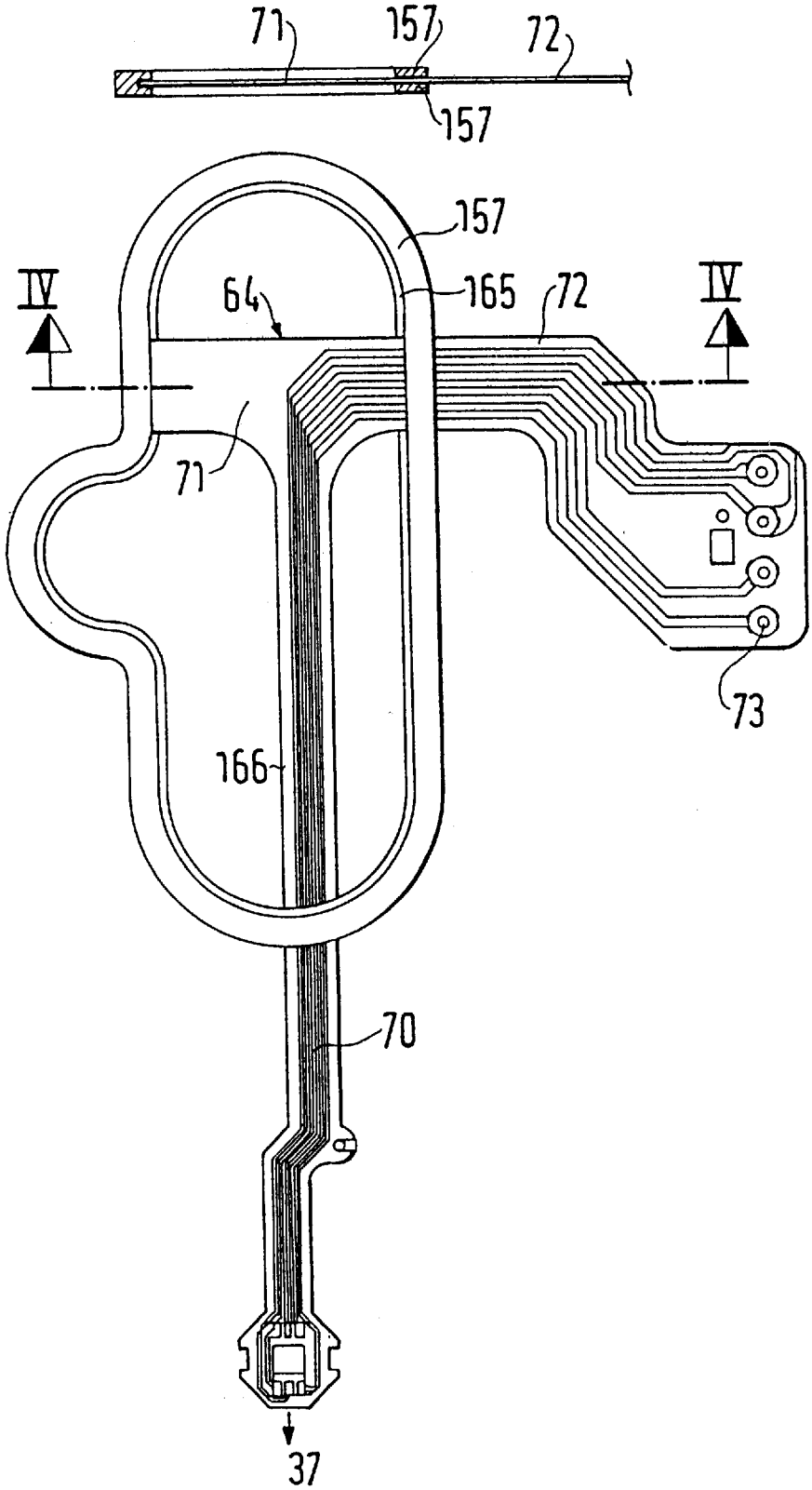
FIG. 4 shows a second embodiment example of the invention with a rubber seal vulcanized on both sides of the carrier film which, routed further as a rubber seal, takes on the form of a sealing face between the closure plate and the housing aperture.

Instead of the design in accordance with FIGS. 2 and 3 with an intermediate plate 51, the arrangement may be designed such that a shaped seal 157 is used in accordance with FIG. 4. It has the shape of the front face 53 which borders the fuel containing space 43 and is now placed between the planar front faces 53 and 60 or into recesses which fix the shaped seal in its position. This shaped seal 157 consists of an annular basic body of carrier film in the same form as that of the front face progression, and sealing compound is applied to both sides of the carrier film. For stabilization, this base body has a cross-brace 71. From the cross-brace, the conductor film tail 166 with the conductor tracks 70, leads off within the enclosure formed by that part of the carrier film 165 which carries the shaped seal 157. Leading outwards is a second carrier film tail 72 which carries the conductor tracks to the contact points 73, where the connection to the flag receptacles 68 is made. At the end of the conductor film tail 166, contact is made to the angle sensor 37. In the installed condition, the carrier film tail 166 which projects over the shaped seal 157 is bent inwards in the manner as shown in FIG. 3 and thus remains in the region of the cross-sectional area of the fuel filled space 43, characterized by the plan view of the shaped seal 157. Instead of as described, the carrier film may merely consist of a cross-brace 71 with the two conductor film tails 166 and 172. In this case, the shaped seal 157 is vulcanized onto the ends of the cross-brace and extends to the outside to form the conductor film tail 72, as can be seen from the section IV—IV. This refinement provides an arrangement which is very easy to handle. The connection leads of the electrical components in the fuel filled space can now be mounted as one entity, together with the shaped seal which seals the fuel filled space. This is made possible particularly by the use of carrier film with conductor tracks which permit a lead-through between the housing wall and the cover, which adds very little in terms of size. The sealing material can be stuck, vulcanized, or sprayed onto the conductor film, depending on the materials used. In a borderline case with pressure differences not being excessive, the conductor film, without coating as a sealant, can be used as a seal itself between the two spaces to be connected. The first named version is then particularly advantageous, in which the carrier film covers the entire front face of the housing wall. No major thickness differences will then result between the conductor track lead-through point and the other regions. It is also possible for the conductor track thus created to be stuck onto the front face of the housing wall.

Figure 5:
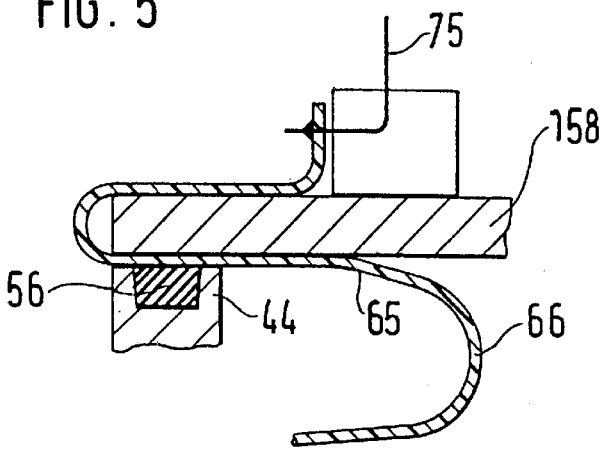
FIG. 5 shows a section through a third embodiment example with a flexible conductor film and a sealing plate as the closure part of the housing in a first embodiment.

A modification of the previous embodiment examples results in that instead of the housing cover 58 shown in FIGS. 2 and 3, a closing part 158 in the form of a closing plate is used, which now merely closes the space 43 on the housing. This closing plate then takes on the function of the intermediate plate 51 in regard to the support of the carrier film. FIG. 5 shows in partial section a portion of the housing wall 44 with a frontal groove 55 and a shaped seal 56. The shown film tail leads into the conductor film 65 which is routed to the outside between the closing plate and the shaped seal 56 and is folded over on the outside and glued to the rear of the closing plate. At this point, the conductor tracks located on the carrier film can be soldered or welded to plug pins 75.

Figure 6:
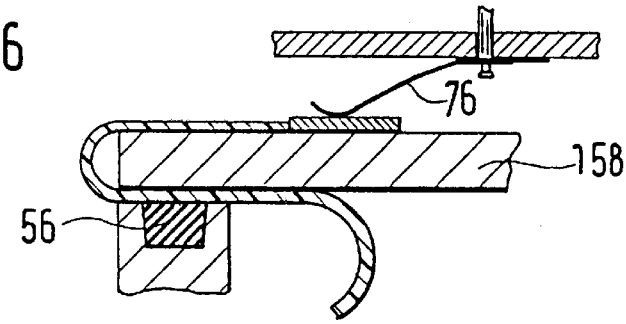
FIG. 6 in a second embodiment with contact facility deviating from that in FIG. 5.

FIG. 6 shows a corresponding arrangement, except that contact with the conductor tracks on the carrier film is made via contact springs 76. The contact springs 76 are connected with the printed circuit board of the control unit or a housing part of the control unit or with an extending part.

FIG. 7 shows various options, some of which have already been mentioned, of the conductor lead-through between the housing 10 and the closing part 58. FIG. 7*a* shows how the carrier film with the conductor tracks is placed flat, without any additional measures needed to be taken, between planar front faces 52 and 60. With the pressure difference not being excessive between the interior, e.g. the fuel filled space 43, and the outer space, e.g. the air-filled outer space 45, the inherent elasticity of the conductor track is sufficient to ensure a tight seal. If the media are identical, then this solution is particularly recommended.

Figure 7A:
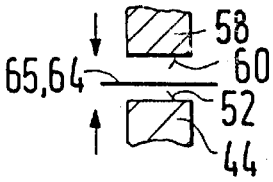
FIGS. 7*a* to 7*g* show the representation of the principle of a fourth to ninth embodiment of the invention.
Figure 7B:
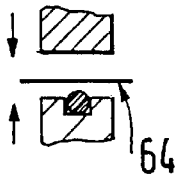
Figure 7C:
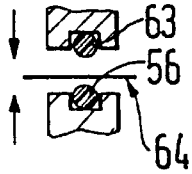
Figure 7D:
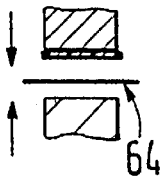
Figure 7E:
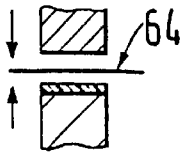
Figure 7F:
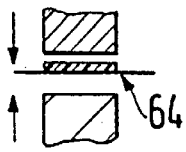
Figure 7G:
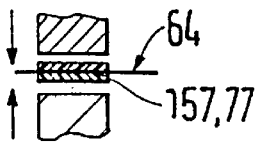

FIG. 7*b* shows the additional use of seal, preferably one inserted in frontal recesses of the housing in accordance with FIG. 2, 5, or 6, but with a simple unsupported carrier film at the lead-through point. To increase the sealing efficiency, the carrier film is enclosed on both sides in accordance with FIG. 7*c* by seals which are placed as shaped seals into the appropriate front faces of the housing and the closing part. It is further possible, as shown in FIGS. 7*d* to *f*, to apply sealing compound on one side, either to the front face of the closing part, to the front face of the housing, or to the conductor film. The best results, albeit at slightly higher expenditure, may be expected from the solution according to FIG. 7*g*, which corresponds to that indicated in FIG. 4, with sealing compound applied on both sides of the carrier film. This solution may also be applied where an intermediate plate or a support plate is used, by, on the one hand, applying sealing compound to the intermediate plate, and, on the other hand, by applying sealing compound to the conductor film which is applied pressure-tight to the other side of the intermediate plate.

Figure 8:
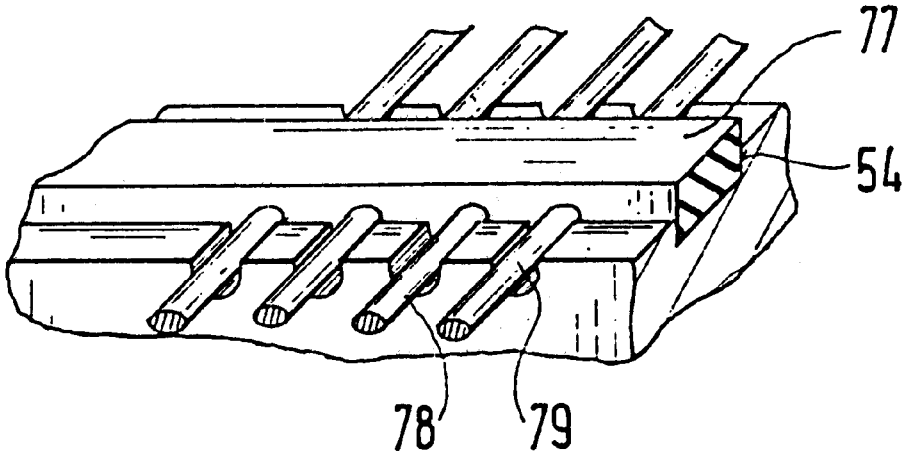
FIGS. 8 and 9 show two further embodiment examples with an elastic seal into which individual conductors have been vulcanized.

With the conductor film and the intermediate plate in accordance with FIGS. 2 and 3, it is also possible to use a combination of conductor plate and conductor film. In this case, the conductor plate takes on the function of the intermediate plate 51, together with the outward leading conductor film. In this case, a film tail is contacted to the conductor plate in the vicinity of the fuel filled space 53. This film tail serves for the flexible connection between a movable sensor, for example, such as the sensor 37 of FIG. 3 and the extending conductor tracks on the conductor plate. Sealing of the conductor plate in the vicinity of the lead-through between the housing and the closing part is analogous to the manner described in the previous embodiment examples. This solution has the further advantage that an almost equally thick intermediate plate lies between the two halves, the housing and the closing part, thus ensuring a good precondition of a secure sealing of the fuel filled space 43 towards the outside. A further embodiment form is presented in FIG. 8. This shows part of a shaped seal 77, which is placed in a recess 54 in the manner of a shaped seal 56, the recess being worked into one of the front faces 53 or 60. The shaped seal projects above the front face, enabling it preferably to locate further in a second recess, which is arranged on the opposite front face. However, in a simple arrangement, this front face will be kept flat. Conductors 78 are vulcanized into the seal across its longitudinal direction, which are thus routed through the gap between the housing and the closing part. To support the seal while keeping the seal thickness as small as possible, grooves 79 branch off from the recess, across the direction of the conductors and enclosing these.

Figure 9:
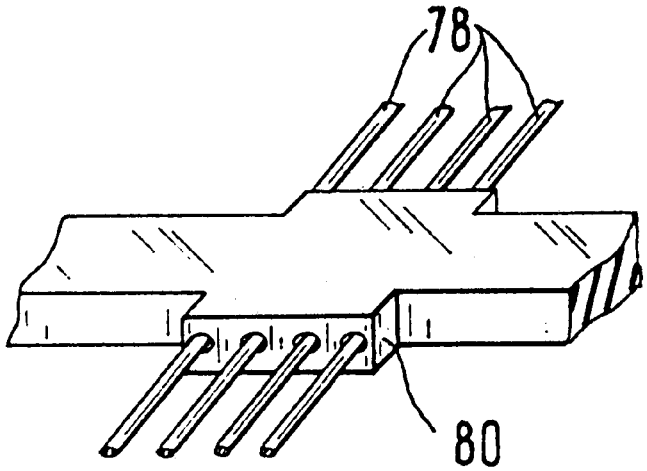

According to FIG. 9, it is also possible for the shaped seal to have a widening 80, in the region of all conductors which are to be routed between the housing and the closing part and which lie next to one another. This widening accommodates the conductors and is routed through an appropriate recess which branches off from the recess 54.

The embodiment examples described previously are not restricted to their use with the shown application in a fuel injection pump, but can also be used in a multitude of other applications, wherever a trouble-free lead-through of conductors from interiors into other spaces is to be accomplished with easy assembly, in particular in the case of large-scale production assemblies. It is then possible to have a flexible routing of the conductors via the shown carrier film tail. It is also possible to provide the carrier films in any form, in a simple manner, in order to cover even complicated applications or housing apertures.

It will be understood that each of the elements described above, or two or more together, may also find a useful application in other types of constructions differing from the types described above.

While the invention has been illustrated and described as embodied in an arrangement for the sealed lead-through of a conductor through the wall of a housing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An arrangement for sealed leading of at least one conductor, comprising a housing having a housing wall which surrounds a housing aperture; a closing part which closes said housing aperture; a seal arranged between said closing part and said housing wall which surrounds said housing aperture; at least one conductor track serving as at least one conductor which is pressure-tightly connected with a conductor track carrier formed by an elastic flexible carrier film, said conductor track carrier being routed between said housing and said closing part, said at least one conductor being insulated and being in close contact with said seal in a closing position of said closing part, said closing part being held to said seal by a closing force; a part of said conductor track carrier having an elastic flexible extension which protrudes within said housing; an electrical component which is movably arranged within said housing, said extension being bent, for contacting said at least one conductor track thereon at an end of said extension directly to said electric component thereby fixing the end of said extension to said electric component which is movably arranged within said housing, so that said end of said extension follows each movement of said electric component.

2. An arrangement as defined in claim 1, wherein said carrier film is composed of polyamide.

3. An arrangement as defined in claim 1, wherein said closing part is formed as a stiff carrier plate, said carrier film being pressure-tightly connected with said carrier plate.

4. An arrangement as defined in claim 1, wherein said carrier film has at least one brace enclosed by said seal, said flexible extension being formed as a carrier film tail provided with conductor tracks and leading through said seal to an exterior of said housing and also leading into an interior of said housing.

5. An arrangement as defined in claim 3, wherein a part of said carrier film is connected to a rear side of said carrier plate, said at least one conductor track being fitted with contacts.

6. An arrangement as defined in claim 1, wherein said housing is formed as a fuel injection pump housing and filled with a pressurized fuel; and further comprising a wall separating said fuel injection pump housing from a housing part thereof which is at atmospheric pressure and in which an electronic circuit is arranged and contacted by an end of said at least one conductor.

7. An arrangement as defined in claim 1, wherein said housing wall and said closing part have adjacent sides, at least one of said adjacent sides being provided with a recess, said seal being formed as a shaped seal embedded in said recess, said at least one conductor being routed through and tightly enclosed by said shaped seal.

8. An arrangement as defined in claim 7, and further comprising an additional recess guiding said at least one conductor and branching off from said recess in a lead-through direction of said at least one conductor.

9. An arrangement as defined in claim 7, wherein said shaped seal extends into said additional recess.

10. An arrangement as defined in claim 1, wherein said housing, said at least one conductor and said closing part constitute adjacent members, said seal being a sealing compound applied to at least one of said adjacent members.

11. An arrangement as defined in claim 1, wherein said housing, said conductor track carrier and said closing part constitute adjacent members, said seal being tightly and adhesively connected with at least one of said adjacent members.

12. An arrangement as defined in claim 1, wherein said carrier film has a ring, said ring having an extension provided on each side and carrying said conductor track, said extensions leading from said ring to an interior of said housing and to an exterior of said housing.

13. An arrangement for sealed leading at least one conductor, comprising a housing having a housing wall which surrounds a housing aperture; a closing part which closes said housing aperture; a seal arranged between said closing part and said housing wall which surrounds said housing aperture; said seal being in close contact with said housing in a closing position of said closing part, said closing part being held to said seal by a closing force; a conductor track carrier being a flexible carrier film to which said seal is attached by vulcanizing; and a conductor track which is tightly connected with said conductor track carrier are routed between said housing and said closing part.

14. A conductor to be sealingly leaded into a housing wall which surrounds a housing aperture and a closing part which closes the housing aperture, said conductor being formed as at least one conductor track which is tightly connected with a conductor track carrier and is insulated, said conductor track carrier being routable between the closing part and the housing wall and being formed as a flexible carrier film which carries said at least one conductor track and to which a seal is fixed on either side and adapted to be arranged between the closing part and the housing wall, wherein said seal is fixed by vulcanizing to the conductor track carrier.

* * * * *